US010486034B2

(12) United States Patent
Ha

(10) Patent No.: US 10,486,034 B2
(45) Date of Patent: Nov. 26, 2019

(54) STABILITY BALL CASE

(71) Applicant: Sungsoo Ha, Seoul (KR)

(72) Inventor: Sungsoo Ha, Seoul (KR)

( * ) Notice: Subject to any disclaimer, the term of this patent is extended or adjusted under 35 U.S.C. 154(b) by 0 days.

(21) Appl. No.: 15/769,080

(22) PCT Filed: Mar. 10, 2016

(86) PCT No.: PCT/KR2016/002393
§ 371 (c)(1),
(2) Date: Apr. 18, 2018

(87) PCT Pub. No.: WO2017/119544
PCT Pub. Date: Jul. 13, 2017

(65) Prior Publication Data

US 2018/0304124 A1 Oct. 25, 2018

(30) Foreign Application Priority Data

Jan. 6, 2016 (KR) ..... 10-2016-0001606

(51) Int. Cl.
*A63B 47/00* (2006.01)
*A63B 43/02* (2006.01)
(Continued)

(52) U.S. Cl.
CPC ..... *A63B 47/00* (2013.01); *A47C 3/16* (2013.01); *A47C 9/002* (2013.01); *A63B 41/08* (2013.01); *A63B 69/0073* (2013.01); *A45C 2003/007* (2013.01); *A47C 4/54* (2013.01); *A63B 21/0557* (2013.01); *A63B 23/0205* (2013.01); *A63B 23/0233* (2013.01); *A63B 26/003* (2013.01); *A63B 41/00* (2013.01); *A63B 43/02* (2013.01);
(Continued)

(58) Field of Classification Search
CPC ..... A63B 47/00; A63B 41/08; A63B 26/003; A63B 2026/006; A45C 2003/007
USPC ..... 206/315.9
See application file for complete search history.

(56) References Cited

U.S. PATENT DOCUMENTS 5,242,348 A * 9/1993 Bates ..... A63B 21/0004 482/105
5,282,777 A * 2/1994 Myers ..... A63B 21/0004 473/576
(Continued)

FOREIGN PATENT DOCUMENTS

JP 50-102484 8/1975
JP 3153082 8/2009
(Continued)

*Primary Examiner* — Mollie Impink
(74) *Attorney, Agent, or Firm* — Lex IP Meister, PLLC

(57) ABSTRACT

The objective of the present invention is to provide a stability ball case configured to store a stability ball therein and, especially, having a weight thereon to prevent the stored stability ball from rolling, thereby avoiding a safety accident that may happen when the stability ball rolls and drops, as well as storing the stability ball at a desired place in a safe and convenient manner. Particularly, another objective of the present invention is to provide a stability ball case configured such that a weight can be attached to and detached from a body constituting the case, whereby the weight can be separated from the body when the case is washed, or when the stability ball is carried, thereby enabling the stability ball case to be safely used and stored, as well as being conveniently used.

1 Claim, 4 Drawing Sheets

(51) Int. Cl.

| | |
|---|---|
| ***A47C 3/16*** | (2006.01) |
| ***A63B 41/08*** | (2006.01) |
| ***A63B 69/00*** | (2006.01) |
| ***A47C 9/00*** | (2006.01) |
| *A45C 3/00* | (2006.01) |
| *A47C 4/54* | (2006.01) |
| *A63B 41/00* | (2006.01) |
| *A63B 26/00* | (2006.01) |
| *A63B 23/02* | (2006.01) |
| *A63B 71/02* | (2006.01) |
| *A63B 21/055* | (2006.01) |

(52) U.S. Cl.
CPC ... *A63B 2041/005* (2013.01); *A63B 2071/026* (2013.01)

(56) References Cited

U.S. PATENT DOCUMENTS 5,399,136 A * 3/1995 Bart ..... A63B 21/227 446/242
5,810,700 A * 9/1998 Orcutt ..... A63B 21/0552 482/121
5,833,587 A * 11/1998 Strong ..... A63B 21/154 482/123
6,186,662 B1 * 2/2001 Jackson ..... A45C 3/00 383/117
7,007,804 B1 * 3/2006 Witherspoon, Jr. ... A63B 47/00 206/579
7,713,180 B2 * 5/2010 Wickens ..... A63B 41/00 482/140
8,882,642 B2 * 11/2014 Chavez ..... A63B 21/0442 482/121
9,744,397 B2 * 8/2017 Pagano ..... A63B 22/18
2005/0143234 A1 * 6/2005 Massey ..... A63B 21/04 482/140
2015/0133279 A1 * 5/2015 Alessandri ..... A63B 21/0023 482/142

FOREIGN PATENT DOCUMENTS

| | | |
|---|---|---|
| JP | 3155209 | 11/2009 |
| KR | 20-0208912 | 1/2001 |
| KR | 20-0283615 | 7/2002 |

* cited by examiner

STABILITY BALL CASE

TECHNICAL FIELD

The present disclosure relates to a stability ball case, and more specifically, to a stability ball case including a weight formed thereon to prevent a stability ball from rolling or arbitrarily being moved when the stability ball is put into the case, thereby allowing the stability ball to be easily stored and to be conveniently used.

BACKGROUND ART

A stability ball (also called "gym ball") is an exercise equipment that allows a user to exercise stretching, yoga, and so on, while trying to keep balance against elasticity of the ball inflated with air. The stability ball helps the user to exercise harder and build muscle strength as the user tries to keep balance and stability. Since such the stability ball is not only simple to exercise but also helps in posture correction of the body, it is effective in promoting muscle strength and flexibility. Patent Documents 1 to 4 below disclose such stability balls and technologies for easily storing and using the stability ball.

(Patent Document 1) Korean Utility Model Registration No. 0469159

Since the stability ball is generally spherical, it is not easy for a beginner exerciser to sit or lie down on it, and therefore it is necessary to use the stability ball only with the help of a professional instructor. Especially for those with weak muscles such as women and elderly people, and so on, it is difficult for them to handle the existing stability balls as they like by themselves. That is, since the conventional stability ball is spherical, if the exerciser does not control the stability ball with proper force and posture, the stability ball would slide uncontrollably on the floor, which may cause the exerciser injuries. In order to solve this problem, a hemispherical upper stability ball portion and a hemispherical lower stability ball portion are connected by an O-ring type connecting portion having protrusions, in which a shape of the lower stability ball portion may be changed into a hemispherical shape or a flat shape according to inflow/outflow of air.

(Patent Document 2) Korean Patent Laid-Open Publication No. 10-2014-0020173 The document discloses a stability ball configured to prevent a certain group of users such as children and elderly people who have difficulty of keeping balance from slipping or falling down during exercising, while allowing these users to exercise as they like and thus promote their health.

(Patent Document 3) Korean Patent Laid-Open Publication No. 10-2014-0060143

The document discloses a rocking chair on which a user can sit and rest comfortably, and more particularly, it discloses a rocking chair having not only a function of a rocking chair, but also a function of a stability ball by performing stability ball movement when necessary.

In order to achieve the above object, the rocking chair disclosed in the above document has a technical characteristic of including a support frame curved to support the back, the hips, and the thighs of a sitting person, a base frame curved to swing a portion in contact with a ground back and forth, fasteners mounted on the base frame to allow the support frame to be engaged, and protrusions formed on an upper surface and a lower surface of the support frame, respectively to be inserted into the fasteners, in which the protrusion formed on the lower surface of the support frame is engaged with the fastener so that the support frame is positioned downwardly concave, or the protrusion formed on the upper surface of the support frame is engaged with the fastener so that the support frame is positioned upwardly convex.

(Patent Document 4) Korean Utility Model Registration No. 0474263

The document discloses a stability ball hanger provides a stability ball hanger consisting of a combination of a support portion having a lower surface contacting a floor, a frame having a predetermined length and installed vertically on the support portion, and a cradle fixed to a side of the frame to enable the stability ball to be mounted thereon, in order to make it possible to easily and conveniently store a spherical stability ball, to reduce the volume by constructing the stability ball in a prefabricated manner and thus to facilitate a transportation of the stability ball during delivery.

However, such stability balls and storing the stability balls have the following problems.

(1) The stability ball is generally spherical in shape and designed to roll easily to provide increased exercise effect for the user as the user is trying to keep the stability ball from moving. This is effective in obtaining exercise effects, but it is difficult to store the stability ball after finishing the exercise.

(2) In other words, the stability ball left on the floor after exercise is restored to its original spherical shape and thus can roll around on the floor, and when the stability ball is removed from the floor and stored on another object, there is a concern that the spherical stability ball may roll down.

(3) There is a possibility that as the stability ball rolls down, another object bumping against the stability ball is damaged, and there also is a risk of injury when the ball impacts toddlers, infants, or elderly.

(4) Certain stability balls are made not to roll, but it is difficult to produce such stability balls.

(5) In addition, in order to solve the problems mentioned above, technologies related to a hanger capable of storing a stability ball are disclosed, but it is troublesome to use such hanger since it is necessary to purchase a hanger separately and install it in a room, or the like.

(6) Further, when there are multiple stability balls, using the hanger can help to effectively store the stability ball in a reduced storage space, but when there is only one single stability ball, it is disadvantageous to use a hanger in terms of space utilization because the hanger occupies a considerable space.

(7) In addition, the hanger is convenient for storing stability balls in a fixed manner in a place like home, but is inconvenient to carry the stability balls around or move it to other places.

DISCLOSURE

Technical Problem

The present disclosure has been made in consideration of the problems mentioned above, and it is an objective of the present disclosure to provide a stability ball case configured to store a stability ball therein and more particularly, to provide a stability ball case having a weight formed thereon to prevent a stored stability ball from rolling, thereby preventing a safety accident that may otherwise occur when the stability ball accidently rolls and drops, while also storing the stability ball at a desired place safely and conveniently.

Specifically, it is another objective of the present disclosure to provide a stability ball case in which a weight is configured to be attached to or detached from a body of the case such that the weight can be separated from the body when it is necessary to wash the case or carry the stability ball around, thereby enabling not only convenient use of a stability ball, but also convenient and safe storage of the stability ball.

In addition, another objective of the present disclosure is to provide a stability ball case in which a weight is attachable to or detached from a body of the case using a Velcro, a zipper, a snap button, or the like, thereby allowing a user to carry around a stability ball in the stability ball case conveniently without worrying about the weight accidently escaping from its position due to a contact with another object or being misplaced.

Technical Solution

To achieve the objectives described above, a stability ball case according to an embodiment of the present disclosure includes a body 100 capable of receiving a stability ball B, in which the body 100 may include a weight 110 for preventing the stability ball B from rolling; an opening means 120 allowing the stability ball B to be put into or taken out of the body 100 therethrough; and a handle 130 configured for picking up or hanging the body (100).

Specifically, the weight 110 is integrally formed with the body 100 by being inserted into a pocket that is integrated with the body 100 by sewing. In addition, the weight 110 is configured to be attachable to or detachable from the body 100 with a zipper, a Velcro or a snap button. In addition, the weight 110 is mounted on an inner surface of the body 100.

Further, the opening means 120 may be a zipper, a Velcro or a snap button.

Lastly, the weight 110 may include at least two fitting rings 113 formed thereon at predetermined intervals to be exposed to the outside of the body 100.

Advantageous Effects

The stability ball case according to the present disclosure has the following effects.

(1) The stability ball, which rolls so easily, is stored in a stability ball case having a weight formed thereon, and thus the rolling of the stability ball can be prevented.

(2) Even when the stability ball case receiving the stability ball therein is placed on other object, the possibility that the stability ball is rolled down or dropped and injure people nearby or damage other objects can be prevented.

(3) Since the weight is configured to be attachable to and detachable from the body, as need arises, the weight can be separated from the body and the stability ball can be conveniently carried around in the stability ball case, or washed or the like, which thus provides convenient use, maintenance and repair.

(4) In an example, since the weight is configured to be attachable to or detachable from the body by a zipper, a Velcro or a snap button, anyone may easily and quickly attach the weight to the body and use it or as need arises, separate the weight and use the stability ball conveniently.

(5) In addition, since the weight is configured to be attachable to or detachable from the body that receives the stability ball, it is possible to prevent the weight from being separated or removed from the body due to contact or interference with surrounding objects during movement with the stability ball case, and accordingly, it is possible to store the stability ball conveniently while keeping the stability ball from rolling with the weight.

(6) Furthermore, since the handle is formed on the body, it is not only easy and efficient to hold the handle to carry around the stability ball received in the ball case, it is also possible to hang the stability ball case by the handle. Accordingly, the stability ball case can be stored easily and space utilization can be increased.

(7) Since the stability ball case according to the present disclosure is folded and stored when not in use, the space occupied by the stability ball case can be reduced.

(8) Meanwhile, since the weight is provided with the fitting rings exposed to the outside of the body, exercise effect can be obtained even with the stability ball being stored in the case or carried around, by inserting an exercise band into the fitting ring, for example.

DESCRIPTION OF DRAWINGS

Other objects and aspects of the present disclosure will become apparent from the following descriptions of the embodiments with reference to the accompanying drawings in which.

BEST MODE

Figure 1:
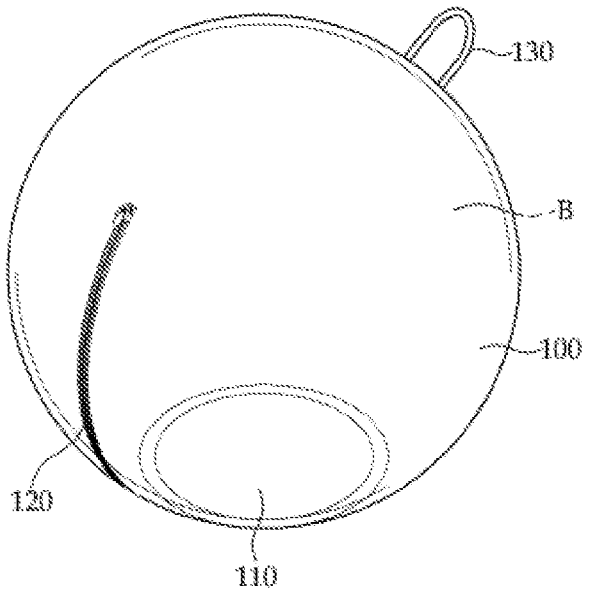
FIG. 1 is a perspective view showing an example in which a weight according to the present disclosure is integrally fixed to a body.

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Accordingly, while the embodiments described herein and the configurations shown in the drawings are the most preferred embodiment of the present disclosure, these do not represent all of the technical ideas of the present disclosure, and therefore, it should be understood that various equivalents and modifications are possible.

(Configuration)

A stability ball case according to the present disclosure includes a body 100 capable of receiving a stability ball B, as shown in FIGS. 1 to 4.

Specifically, a weight 110 is formed on the body 100 to keep the stability ball B stored therein from rolling, thereby preventing possibility that the stability ball B is rolled and dropped, damaging surrounding objects or injuring people nearby.

Further, the weight 110 is configured to be attachable to or detachable from the body 100, and thus the weight 110 or the body 100 is prevented from being damaged when the stability ball case storing the stability ball B therein is carried around or washed.

Hereinafter, this configuration will be described in more detail. In the examples described below, the stability ball B may be a stability ball that is manufactured by inflating air with a known technique to be used for stretching, yoga, or the like.

Figure 2:
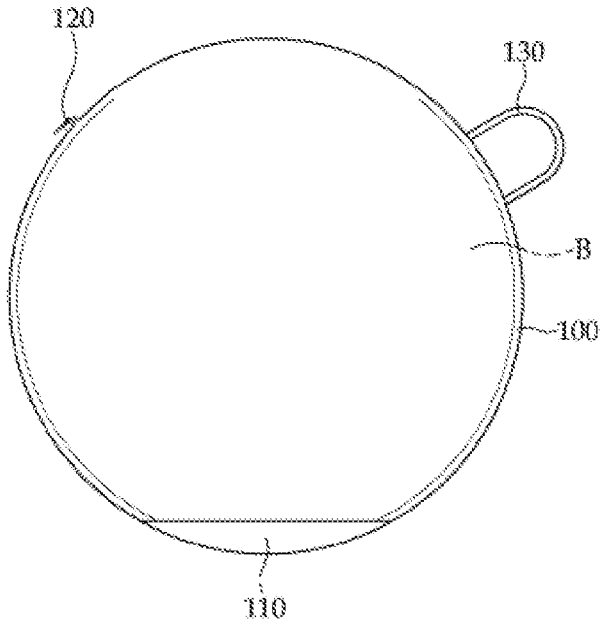
FIG. 2 is a front view for showing an example in which the weight according to the present disclosure is integrally fixed to the body.

The body 100 is manufactured in size that can receive the stability ball B therein, as shown in FIGS. 1 and 2. The body 100 may be made from various materials such as fabric or synthetic resin, and preferably manufactured so that it may be folded and stored when not in use.

Further, the body 100 also includes a weight 110 formed thereon as shown in FIGS. 1 and 2. The weight 110 serves to prevent the stability ball B from rolling when the stability ball B is received in the body 100. The weight 110 may be formed on an outer surface of the body 100 or may be formed on an inner surface of the body 100.

In the preferred embodiment of the present disclosure, it is preferable that the weight 110 is configured within the body 100 and not exposed to the outside and is not interfered with the other elements or objects around the case.

In addition, in the preferred embodiment of the present disclosure, the weight 110 may be integrally formed with the body 100, by being placed into a pocket-like storage space that is sewn to the body 100 or may be configured to be separated from the body 100. In an example, it would be most preferable that the weight is configured as a removable type such that when the stability ball case according to the present disclosure is washed or carried around with the stability ball B being received therein, the weight 110 is separated to allow convenience use of the stability ball case.

Figure 3:
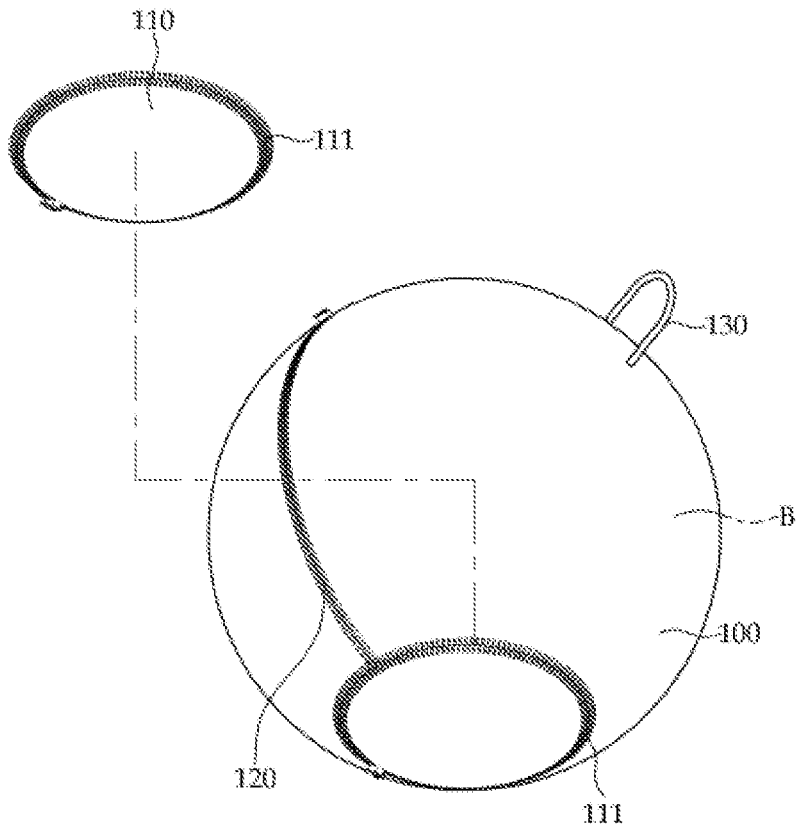
FIG. 3 is a perspective view showing an example in which the weight according to the present disclosure is configured to be attachable to or detachable from a body by a zipper.
Figure 4:
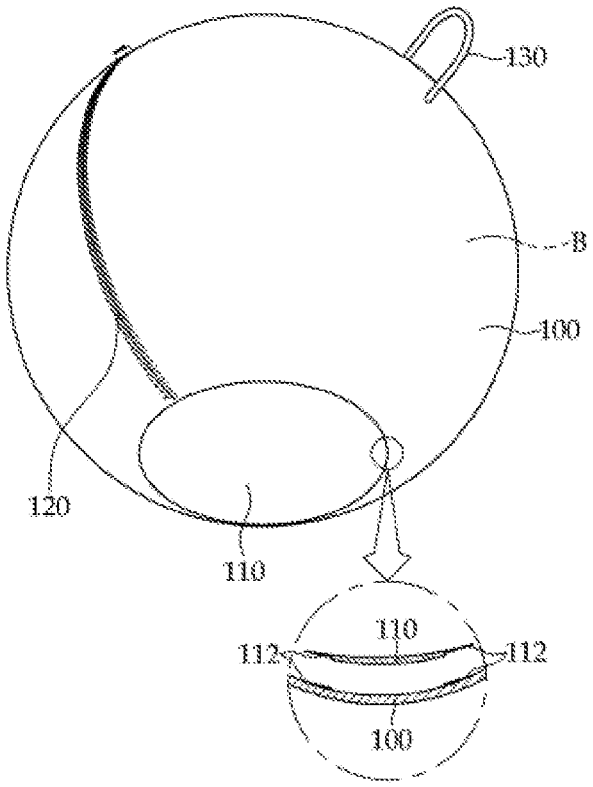
FIG. 4 is a perspective view showing an example in which the weight according to the present disclosure is configured to be attachable to or detachable from a body by a Velcro.

In an example, any configuration that allows easy and convenient separation of the weight 110 from the body 100 may be used, such as a zipper 111 as shown in FIG. 3, a Velcro 112 as shown in FIG. 4, or a snap button, for example. The zipper 111 refers to that made by a conventional technique in which two tape strands having teeth formed on each edge are closed by engaging the teeth in a sliding manner. The Velcro 112, or a hook-and-loop binding widely known as Velcro, refers to that which is made by a well-known method in which hooks formed on one side and loops formed on the other side are mated with each other or separated from each other. The snap fastener, widely known as a snap button, refers to a known fastening device that includes a socket disc and a ball disc faced each other and pushed until they are snap-fitted.

An opening means 120 is formed in the body 100 such that the stability ball B may be put into, or taken out of the body 100 therethrough, as shown in FIGS. 1 to 4. Any structure may be used as the opening means 120 as long as it allows the stability ball B to be taken out of the body 100 therethrough. For example, a zipper, a Velcro or a snap button may be used as the opening means. Since this configuration has been already described above by referring to fixing the weight 110, detailed description thereof will be omitted for the sake of brevity.

In the preferred embodiment of the present disclosure, the opening means 120 may be formed anywhere as long as the stability ball B can be put into the body 100 therethrough, while it is preferable to form the opening means 120 at a position facing the weight 110 described above. This is to allow the opening means 120 to be opened so that the stability ball B can be easily put into the body 100.

A handle 130 is formed on the body 100 to allow the user to grip it and carry the stability ball case, as shown in FIGS. 1 to 4. Specifically, it is preferable that the handle 130 is formed in a ring shape, in which case the handle 130 can not only serve as a handle, but also allows the user to hang a stability ball case by the handle 130 when need arises.

Figure 5:
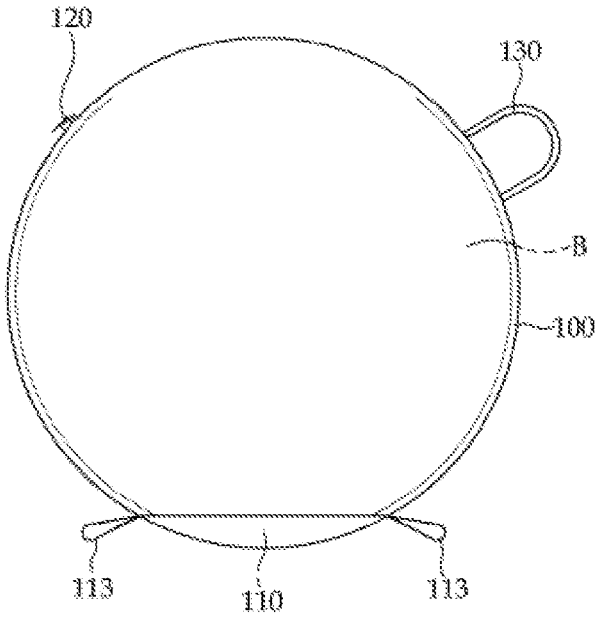
FIG. 5 is a front view for showing an example in which two fitting rings are added to the weight according to the present disclosure.

In the meantime, it is preferable that the stability ball case according to the present disclosure further includes at least two fitting rings 113 on the weight 110, as shown in FIG. 5. In this example, it is preferable that the fitting rings 113 are made from a material that is easily folded like a fabric, and preferably exposed to the outside of the body 100

These fitting rings 113 are designed to allow a user to perform an exercise such as stretching even in a state that the stability ball is received in the stability ball case, by inserting a band or the like in the rings 113 and then using the inserted band.

In this case, it is preferable that at least two fitting rings 113 are formed so that the exerciser holds at least one fitting ring 113 in each hand. Of course, a plurality of fitting rings 113 may be formed and used in a variety of manners. For example, an exerciser may insert bands in the fitting rings formed at different positions or shorten the length of a band by inserting one single band in several fitting rings.

Further, it is preferable that the fitting rings 113 are formed at predetermined intervals, or most preferably, at equal intervals so that the same load can be applied when using bands and so on.

As described above, according to the present disclosure, since the weight is formed on the case capable of storing the stability ball, it is possible to store the stability ball safely and conveniently, and to take out and then conveniently use it at any time, and it is also possible to carry the stability ball easily and conveniently, and wash and use the stability ball case conveniently.

What is claimed is:

1. A stability ball case, comprising a body capable of receiving a stability ball therein, wherein the body comprises:

a weight for preventing the stability ball from rolling;

an opening means through which the stability ball is put into or taken out of the body, the opening means comprises a zipper;

and a handle provided between a top and a mid-portion of the body and configured for picking up or hanging the body, wherein the weight is configured to be attachable to or detachable from the body with a zipper attached to the perimeter of the weight and wherein the body comprises a complimentary zipper for mating with the zipper of the weight, and the weight comprises two fitting rings exposed outside of the body in a state that the weight is attached to the body with the zipper.

* * * * *